United States Patent [19]

Lepisto

[11] Patent Number: 4,576,210

[45] Date of Patent: Mar. 18, 1986

[54] DUCK BILL FILLER NOZZLE

[75] Inventor: J. George Lepisto, Middletown, Ohio

[73] Assignee: Champion International Corporation, Stamford, Conn.

[21] Appl. No.: 745,380

[22] Filed: Jun. 17, 1985

Related U.S. Application Data

[63] Continuation of Ser. No. 540,378, Oct. 11, 1983, abandoned, which is a continuation-in-part of Ser. No. 424,893, Sep. 28, 1982, Pat. No. 4,498,511.

[51] Int. Cl.[4] ..... B65B 1/18

[52] U.S. Cl. ..... 141/115; 141/119

[58] Field of Search ..... 141/10, 65, 68, 85, 141/89, 114, 115, 116, 119, 313, 317

[56] References Cited

U.S. PATENT DOCUMENTS

| | | | |
|---|---|---|---|
| 2,296,163 | 9/1942 | Hartman | 141/10 |
| 3,118,474 | 1/1964 | Eppolito | 141/68 |
| 3,258,041 | 6/1966 | Lau | 141/68 X |
| 4,066,108 | 1/1978 | Lau | 141/68 |
| 4,219,054 | 8/1980 | Carter et al. | 141/10 |
| 4,311,173 | 1/1982 | Sailors, Jr. | 141/68 |
| 4,387,749 | 6/1983 | Donisi | 141/68 |

FOREIGN PATENT DOCUMENTS

| | | | |
|---|---|---|---|
| 544402 | 1/1956 | Belgium | 141/68 |
| 940315 | 10/1963 | United Kingdom | 141/68 |

*Primary Examiner*—Stephen Marcus
*Assistant Examiner*—Mark Thronson
*Attorney, Agent, or Firm*—Evelyn M. Sommer; William W. Jones

[57] ABSTRACT

A filling nozzle for use in filling a valve bag eliminates sifting of product during and after the filling operation. A body member, adapted for insertion into the valve sleeve, has a material passage therethrough adapted to direct a stream of product emerging therefrom through the valve. A vent is provided, connected to a first conduit, for continuously drawing a low vacuum between the nozzle and the sleeve, both during and after the filling operation, to remove any product particles there present. A second conduit is provided for introducing a high pressure blast of air into the material passage to remove any product remaining therein after a bag has been filled. Finally, a third conduit is provided for drawing a high vacuum in the material passage to remove any particles remaining therein after the filling operation has been completed. The body member is tapered, with a configuration like a duck bill, so as to provide an effective seal between the nozzle and the valve sleeve and to fully occupy the sleeve so as to eliminate voids wherein product could become entrapped.

1 Claim, 6 Drawing Figures

DUCK BILL FILLER NOZZLE

BACKGROUND OF THE INVENTION

This application is a continuation of application Ser. No. 540,378, filed Oct. 11, 1983, now abandoned, which is a continuation-in-part of my co-pending application Ser. No. 424,893, filed Sept. 28, 1982, now U.S. Pat. No. 4,498,511, entitled "Apparatus and Method for Filling Valve Bag."

The present invention relates to the filling of valve bags with particulate material and, more particularly, to an improved filling nozzle which eliminates the sifting of product from the valve bag during and after the bag filling operation.

Particulate materials are commonly packaged in bags that are made from multiple layers of paper and have a "valve" in one upper corner. The valve provides an opening through which the material is introduced during the bag filling operation. The valve bag is typically filled by inserting a spout or nozzle into the valve and causing material to flow through the nozzle into the bag. When the bag is full, the flow of material is halted and the nozzle is withdrawn from the valve usually by moving the bag away from the nozzle. The valve is sealed to prevent egress of the material from the bag during shipping and handling.

The nozzle of the present invention is particularly suited for use in conjunction with control systems of the type disclosed in the previously mentioned parent application Ser. No. 424,893 and with the filler sleeve disclosed in co-pending U.S. patent application Ser. No. 300,038, filed Sept. 8, 1981. This filler sleeve comprises an elongated tubular member which is connected to the top end of the bag. The tubular member includes an open end which is contiguous with a filler opening provided in the top end of the bag. The opposed end of the tubular member is closed, e.g., by heat sealing or folding. A longitudinally extending slit is provided in the tubular member, disposed on the bottom surface thereof. In use, when the bag is filled by introducing the product by air flow or by gravity through a filler nozzle which is inserted into the filler opening and into the tubular member, the product is deflected downwardly into the bag, thereby inhibiting the likelihood of blow-out of the side panels. Preferably, the tubular member is formed from a stretchable material such as polyethylene, so that during the filling of the bag and the flow of the product stretches the material. By this arrangement, when the filling is completed, and the bag is inverted, the side edges of the slit, which have been stretched, overlap and the weight of the product functions to maintain the overlapping relationship thereby preventing the unwanted escape of product from the bag.

While the filling nozzle of the present invention is particularly suited for use with the slitted filler sleeve disclosed in the aforementioned co-pending application, those skilled in the art will appreciate that the present filling nozzle is also adaptable for use in conventional valve bags.

In filling valve bags, problems have been encountered in reducing eliminating the sifting and dusting problems which can occur during the filling process and after filling is completed, e.g., during transit. This latter problem can occur if material is entrapped in the valve during the filling process. Such entrapment of material can occur if the filling nozzle does not occupy the full volume of the sleeve. Specifically, present nozzles are round, while the valve sleeve and bag are fla and have a tendency to remain so. When the bag i placed on the nozzle, voids remin between the nozzl and the sleeve and product becomes entrapped therein In addition, an effective seal must be provided betwee the nozzle and the valve sleeve to prevent the escape o product during the filling operation. Such a seal is diffi cult to establish, due to the aforementioned geometri difference.

Various hazardous products such as toxic chemicals clay, limestone, cement, carbon black, herbicides, fungi cides, and the like are frequently packaged in valv bags. The elimination of product sifting problems is therefore, imperative.

Clearly, it would be advantageous if the nozzle pro vided an effective seal against the valve sleeve durin the filling operation and if it were configured to full occupy the sleeve so as to eliminate or prevent an voids wherein product could become entrapped.

SUMMARY OF THE INVENTION

The filling nozzle of the present invention comprise a body member having a material passage therethrough and means for drawing a low vacuum at the externa surface thereof. First conduit means are provided fo drawing a low vacuum through the vent means of the nozzle to draw out any product particles present in the valve sleeve during or after the filling operation. Second conduit means are provided for introducing a high pressure blast of air into the material passage of the nozzle to clear the nozzle of any residual product therein after a valve bag has been filled. Conduit means are also provided for introducing a high vacuum into the material passage of the nozzle to remove any particles remaining therein after the introduction of the high pressure blast.

In addition, the body member is configured so as to substantially fill a valve sleeve when inserted therein with the nozzle discharge opening aligned with the valve and is, furthermore, tapered so as to seal there-against upon insertion.

DETAILED DESCRIPTION OF THE INVENTION

Figure 1:
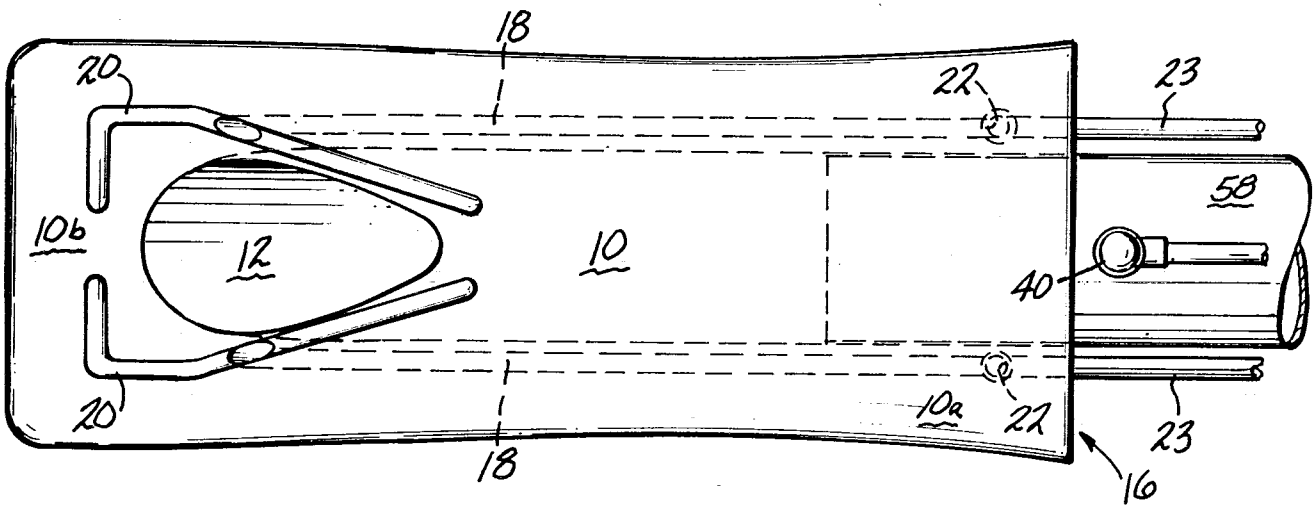
FIG. 1 is a bottom plan view, with partial cut-away, showing a nozzle in keeping with the present invention.
Figure 2:
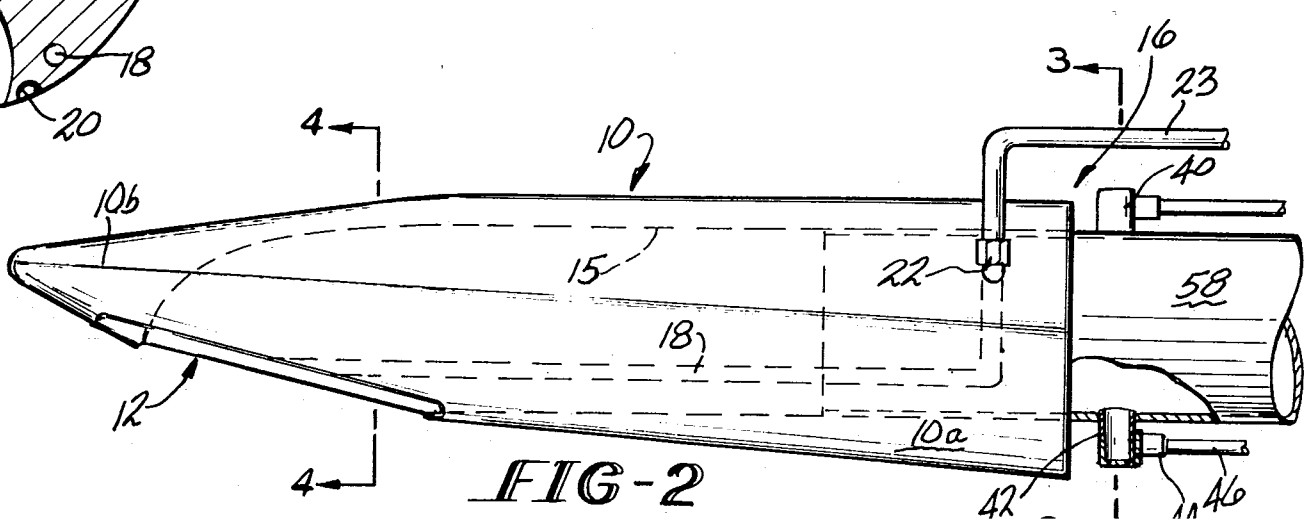
FIG. 2 is a side plan view, with partial cut-away, of the nozzle shown in FIG. 1.
Figure 4:
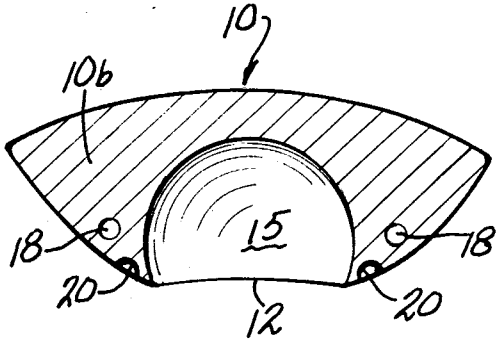
FIG. 4 is a cross-sectional view taken substantially along the line 4—4 shown in FIG. 2.
Figure 3:
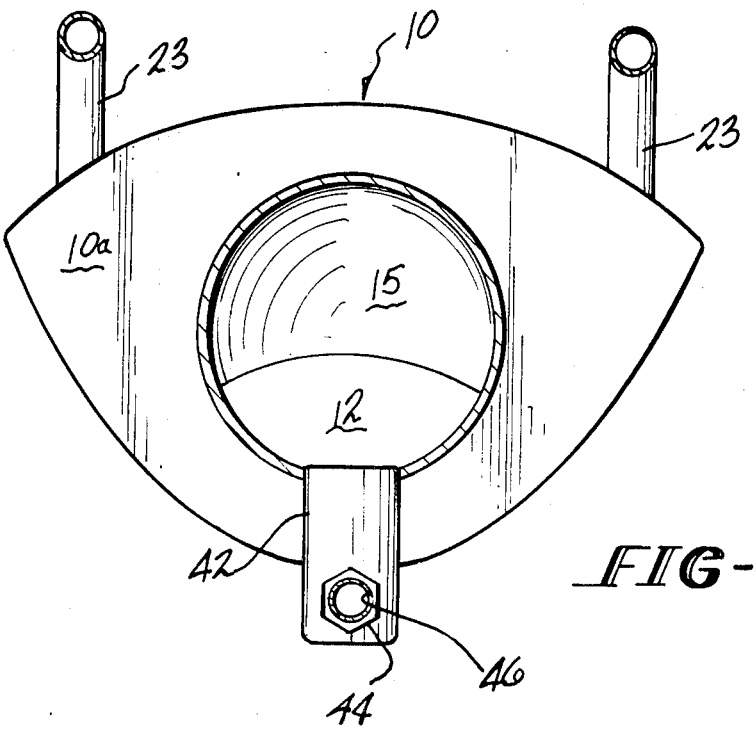
FIG. 3 is a cross-sectional view taken substantially along the line 3—3 shown in FIG. 2.
Figure 5:
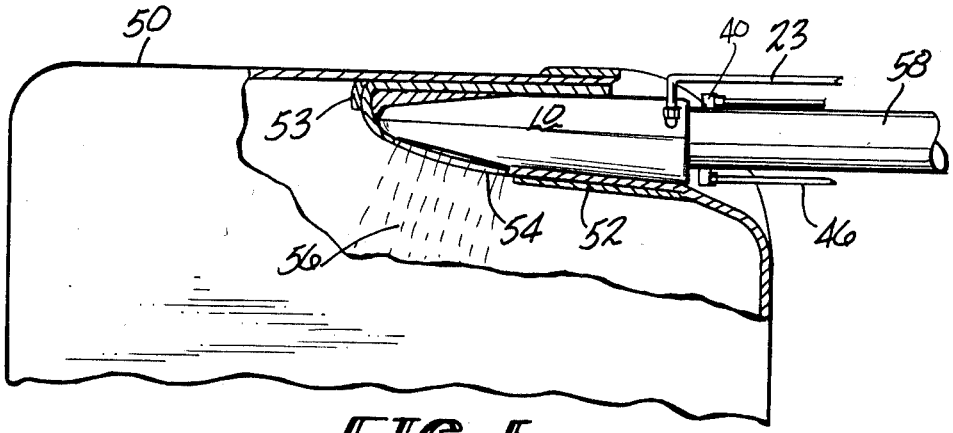
FIG. 5 is a cross-sectional view showing the nozzle of FIGS. 1—4 filling a valve bag through a slitted valve sleeve.

The overall structure of a filling nozzle arranged in keeping with the present invention is shown in FIGS. 1 and 2. The nozzle includes an elongated body member 10 which is hollow to provide a material passage 15 therethrough. In filling a valve bag, the nozzle is inserted into the bag as shown in FIG. 5. Product flows into end 16 of the nozzle through product supply conduit 58. The product, which is typically a particulate material, emerges from the nozzle through opening 12. The valve bag shown in FIG. 5 includes a valve sleeve 52 having a slit 54 therein through which particulate material 56 passes. Once particulate material 56 has passed through slit 54, it is within the interior of bag 50.

In valve bag filling nozzles of prior design, the opening at which the particulate product emerges for filling the bag is not designed to direct the flow of material exiting therefrom thrugh a slitted valve sleeve. When such prior nozzles are used in conjunction with a slitted sleeve, such as sleeve 52 shown in FIG. 5, product is forced into the closed end 53 of sleeve 52 where it can become lodged or otherwise remain after the filling of the bag has been completed. Product remaining at end 53 of valve sleeve 52 can later find its way out of the valve sleeve, causing the material (which may be hazardous or toxic) to exit from the bag. Any such leakage of product from the bag is highly undesirable. Further, nozzles of prior design can cause the closed end 53 of valve sleeve 52 to rupture due to the direct force of material which impacts the closed end.

In the filling nozzle shown, opening 12 is situated so that when the nozzle is inserted into a slitted valve sleeve, the product flowing through the nozzle will be directed through the slit and into the bag, thereby minimizing the risk that the product will be caught in the closed end of the valve sleeve. The design of opening 12, by directing product downwardly, also prevents the rupture of the closed end of the valve sleeve.

The filling nozzle of the present invention also includes various means for clearing the nozzle of residual particulate material after the product flow has ceased and for removing any particulate material, which may otherwise remain in the valve sleeve after the bag has been filled.

Both during and after the filling operation, a low vacuum is drawn between the nozzle and the valve sleeve at grooves 20, flanking opening 12, which serve to distribute the vacuum effect. Grooves 20 are connected, at their midpoints, to conduits 18 which, in turn, are coupled, through couplings 22, to hoses 23 which carry the vacuum. The purpose of drawing a vacuum between the nozzle and the valve sleeve into which the nozzle is inserted is to remove any particulate product material there present. Any such particles remaining in the valve sleeve after the bag has been filled are referred to as "dribblings."

After a bag has been filled with product flowing through the nozzle and prior to the removal of the filled bag from the nozzle, a blast of high pressure air is introduced into material passage 15 of the nozzle to clear the nozzle of any particulate material remaining therein. The blast of high pressure air is pased through hose 46 to conduit 42. Hose 46 is coupled to conduit 42 by coupling 44. In the operation of the filling spout, the blast of high pressure air will typically be at a pressure on the order of 100 pounds per square inch.

As the dribblings are being removed, a high vacuum is drawn through conduit 40 which communicates with material passage 15. This high vacuum is drawn after the introduction of the blast of high pressure air and serves to remove any material still remaining in material passage 15. When the nozzle is used in conjunction with a slitted valve sleeve, as shown in FIG. 5, the internal pressure of the aerated product in the filled bag forces the slit to close, thereby preventing the vacuum within the material passage 15 from drawing any product (other than dribblings) out of the filled bag. Thus, slit 54 can be analogized to a one-way valve, which allows product to enter, but not exit, from the bag.

As previously mentioned, a schematic diagram of a control system, of the type suitable for use with the present nozzle, may be found in the aforementioned application Ser. No. 424,893.

As best seen in FIGS. 1–4, body member 10 tapers toward the discharge end of the nozzle in a configuration which can best be described as shaped like a duck bill, i.e., it is of substantially rectangular plan form and comprises a base portion 10*a* having diamond shaped cross-sections (see FIG. 3) which progressively diminish in area toward the distal or discharge end of the nozzle. Base portion 10*a* merges into a pyramidal tip member 10*b* wherein is situated discharge opening 12.

Figure 6:
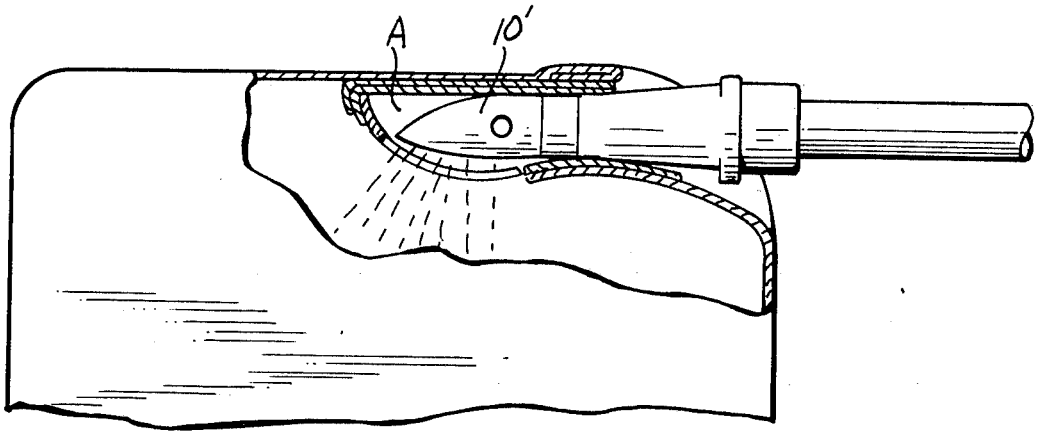
FIG. 6 is a cross-sectional view, similar to FIG. 5, showing the bag thereof being filled through a round nozzle.

It will be readily appreciated that tip member 10*b* is specifically adapted to facilitate the insertion of the nozzle into a valve sleeve. Likewise, the taper of base portion 10*a* ensures that, as the nozzle is inserted into the sleeve, it forms an effective seal thereagainst. Thus, insertion will continue, i.e., the depth of penetration will increase, until the base portion of the body member firmly grips the sleeve, at which point, the desired seal has been created. Further, as best seen in FIG. 5, the unique configuration of body member 10 allows the present nozzle to fully occupy the essentially flat sleeve so as to avoid the creation of voids, between the nozzle and the sleeve, which could subsequently become filled with entrapped product. Such voids A are shown in FIG. 6, wherein a valve bag is being filled through a nozzle having a body member 10' of round cross-section.

What is claimed is:

1. A nozzle for use in filling a bag having a valve sleeve, said nozzle comprising:

(a) a body member adapted for insertion into the valve sleeve, said body member having a material passage therethrough for passage of product into the bag, said body member being substantially rectangular in plan form, and said body member having a product discharge opening disposed at a discharge end of said body member, said discharge opening communicating with said material passage;

(b) at least one vacuum conduit in said body member, said vacuum conduit being operable to be connected to a vacuum source to allow drawing of a vacuum in said vacuum conduit;

(c) groove means comprising a pair of grooves flanking said product discharge opening and formed in an outer surface of said body member, said groove means being connected to said vacuum conduit whereby said groove means is operable to distribute the vacuum drawn in said vacuum conduit to remove product residue from within the valve sleeve after the bag is filled; and (d) means for removing residual product from said material passage after the bag is filled.

* * * * *